US006581419B1

(12) United States Patent
Strodtman

(10) Patent No.: US 6,581,419 B1
(45) Date of Patent: Jun. 24, 2003

(54) HASP AND LOCK COVER FOR CARGO DOORS

(76) Inventor: Forrest E. Strodtman, 12934 Hidden Castle, Houston, TX (US) 77015

( * ) Notice: Subject to any disclaimer, the term of this patent is extended or adjusted under 35 U.S.C. 154(b) by 0 days.

(21) Appl. No.: 10/092,268

(22) Filed: Mar. 7, 2002

(51) Int. Cl.[7] ..... E05B 67/38

(52) U.S. Cl. ..... 70/56; 70/212; 292/205; 292/DIG. 32

(58) Field of Search ..... 70/54–56, 202, 70/203, 211, 212, DIG. 43, DIG. 56; 292/148, 205, DIG. 32

(56) References Cited

U.S. PATENT DOCUMENTS

| | | | | |
|---|---|---|---|---|
| 547,550 A | * | 10/1895 | Hopkins | |
| 3,151,898 A | * | 10/1964 | Olander | |
| 4,898,008 A | | 2/1990 | Eberly | 70/56 |
| 5,118,149 A | | 6/1992 | Emmons | 292/327 |
| 5,154,458 A | | 10/1992 | Cook et al. | 292/218 |
| 5,168,258 A | | 12/1992 | Radke | 70/54 X |
| 5,477,710 A | * | 12/1995 | Stefanutti | 70/56 |
| 5,737,946 A | * | 4/1998 | Sole et al. | 70/54 |
| 5,743,118 A | | 4/1998 | Anderson | 70/56 |
| 5,775,747 A | * | 7/1998 | Navarsky | 70/211 X |
| 5,975,595 A | * | 11/1999 | Lorenzo | 70/56 X |
| 6,009,731 A | * | 1/2000 | Emmons et al. | 70/56 |
| 6,010,166 A | * | 1/2000 | Hamilton et al. | 70/56 X |
| 6,357,266 B1 | * | 3/2002 | Van Buren | 70/56 |

FOREIGN PATENT DOCUMENTS

| | | | | |
|---|---|---|---|---|
| GB | 2185519 | * | 7/1987 | 70/54 |

* cited by examiner

*Primary Examiner*—Lloyd A. Gall
(74) *Attorney, Agent, or Firm*—Kenneth A. Roddy

(57) ABSTRACT

A hasp and lock cover for installation on a camming handle of a cargo door of cargo carrying vehicles and shipping containers to substantially cover existing top and bottom hasp elements and the shackle of a lock device installed through the hasp elements. The cover is a unitary rigid box-like device having a contiguous front wall, laterally opposed side walls, a top end wall, an open back side, and an open bottom end defining an interior. Axially aligned apertures through each laterally opposed side wall are sized and shaped to slidably receive the camming handle of the cargo door. A recess in the top end wall is sized and shaped to allow pivotal movement therethrough of the top hasp element into and out of the cover interior. The open bottom end allows the lock device to be manually inserted upwardly therethrough into the interior and manipulated to secure the shackle through aligned apertures in the top and bottom hasp elements. The open bottom also allows the user to easily grip and hold the body of the lock with the fingers of one hand while using a key held in the other hand to lock and unlock the lock device. The open back side and bottom end allow the cargo door camming handle to be raised, lowered, and pivoted while the cover is installed on the handle and the handle is free of the top hasp member.

3 Claims, 3 Drawing Sheets

HASP AND LOCK COVER FOR CARGO DOORS

BACKGROUND OF THE INVENTION

1. Field of the Invention

This invention relates generally to security devices for for cargo doors of cargo carrying vehicles and shipping containers, and more particularly to a box-like cover removably received on the cargo door camming handle and configured to substantially cover the hasp elements, a portion of the handle locked in the hasp, and the shackle of a lock installed through the hasp elements.

2. Brief Description of the Prior Art

Conventional cargo carrying vehicles such as tractor trailers and shipping containers have swing-out cargo doors that include a vertical locking bar and a horizontally extending locking arm or camming handle pivotally attached to the vertical bar. The vertical locking bar has a locking element or cam that engages with a corresponding slot or keeper mounted in the frame surrounding the cargo door when the doors are in their closed position and the locking arm or camming handle is in a position parallel with the door and is disengaged when the locking arm or camming handle is rotated to a position perpendicular to t,he cargo door.

The locking arm or camming handle is secured in a horizontal position parallel to the cargo door by a latch or hasp assembly. The conventional latch or hasp assembly has a vertical backing plate which is secured to the cargo door and an upper and lower hasp member connected to the backing plate. The lower hasp member, also known as a bracket or staple is stationary and has a U-shaped portion which receives and supports the lever arm or camming handle in its horizontal position and has a horizontal flange extending outwardly from the U-shaped portion. The upper hasp member is pivotally connected at its upper end to the backing plate and is shaped to cover the lever arm or handle when it is supported in the lower hasp member. The upper hasp member is free to rotate or swing in a vertical plane about its pivotal connection and also has a horizontal flange. The horizontal flanges of the upper and lower hasp members are provided with aligned holes for receiving the shackle of a lock therethrough to secure the lever arm or camming handle in the hasp assembly. In the case of cargo shipping containers, a pin or a breakaway seal may be installed through the aligned holes of the hasp assembly.

When the doors are to be opened, the lock is removed and the top hasp member is pivoted upwardly clockwise or counter-clockwise to uncover the lever arm or camming handle and the lever arm or camming handle is pivoted upwardly from the lower hasp member and then rotated outwardly to a position perpendicular to the cargo door to rotate the vertical locking bar and disengage its locking element from its corresponding slot or keeper mounted in the frame surrounding the cargo door and the doors can be swung open.

Cargo carrying vehicles and shipping containers having the above described types of latching assemblies are particularly vulnerable to theft, since the hasp and lock is exposed and the hasp or shackle can easily be cut using bolt cutters or hacksaws or the lock can be defeated using simple burglary tools.

Another problem with these types of latching assemblies is that the lock is exposed to environmental conditions such as precipitation and road spray which may freeze, making the lock difficult to open, and are subject to considerable amounts of dust and dirt which may eventually cause the internal lock mechanism to fail.

Eberly, U.S. Pat. No. 4,898,008 and Cooke et al, U.S. Pat. No. 5,154,458 disclose modified latch assemblies which are secured to the cargo door and have a stationary lower member that receives the locking arm or door handle and a pivoting upper block member which swings down and covers the locking arm. The upper block member is provided with flanges that protect the shackle of a lock installed through aligned holes or over projections in the upper and lower members.

Emmons, U.S. Pat. No. 5,118,149 discloses a protector device for a hasp of a shipping container. The device is a box-like member having top and bottom plates, left and right side plates, a front face plate, and an open rear face. A shield plate extends transversely between the side plates and forms a top opening between the shield plate and the top plate and a bottom opening between the shield plate and the bottom plate. The shield plate is provided with a hole which is aligned with the holes in the hasp members and a breakaway seal is installed through the aligned holes. The protector device is supported on the hasp and protects the hasp from intentional breakage.

Radke, U.S. Pat. No. 5,168,258 discloses a protective device comprising a rectangular base that is secured to the cargo door and surrounds the existing latch assembly and a box-like cover hinged to the bottom of the base that pivots upwardly to a closed position covering the latch assembly, a portion of the locking lever (handle) and a lock secured through the latch assembly. The side walls of the cover are provided with cutouts which receive the locking lever when the cover is in the closed position. An audible alarm is contained in the cover and a switch is mounted to the cover for sounding an alarm upon detecting displacement of the cover from its closed position.

Anderson, U.S. Pat. No. 5,743,118 discloses a lock guard that covers a conventional tractor trailer door latch system. The device comprises a box-like main unit having a front face panel, opposed top and bottom panels, and left and right side panels. The left side panel has a rectangular opening and an exterior rectangular extension having a rectangular opening extends outwardly from the left side panel that slidably receives the door handle. An interior flat plate having a hole through one end extends inwardly from the left side panel above the rectangular opening and fits between the overlapping horizontal legs of the conventional hasp members. The right side panel is provided with an enlarged trapezoidal opening. A conventional lock is installed through the enlarged trapezoidal opening in the right side panel. Finger holes are provided through the front, top, and bottom panels for manipulating the lock into position. Rectangular recesses are provided in the top and bottom panels and are dimensioned to permit clearance for the vertical locking bars (shown in the drawings to be the vertical portion of the hasp plate and hasp members).

The Anderson device requires substantially precise alignment of the conventional handle and hasp members. It also requires inserting and removing the padlock from the trapezoidal opening in the right side panel and hooking and unhooking the shackle of the padlock through the holes in the horizontal legs of the hasp members and interior panel by the installer using only one finger inserted through a finger hole to manipulate the lock, which is submitted to be a difficult and time consuming task and could possibly cause injury to the finger of the installer. It would also be extremely difficult to align the hole of the interior panel with the holes in the horizontal legs of the hasp members since it is offset to the left of the finger holes and would be blocked from view by the lock which is being inserted through the opening in the right side panel. Since the recesses in the top and bottom plates only provide clearance for the vertical portions of the hasp assembly, it is assumed that in order to remove the door handle from the hasp one would have to insert a finger through a finger hole and pivot the top hasp member away from the bottom member using one finger while at the same time lifting the handle upwardly and outwardly from the hasp assembly.

The present invention is distinguished over the prior art in general, and these patents in particular by a hasp and lock cover for installation on a camming handle of a cargo door of cargo carrying vehicles and shipping containers which substantially covers existing top and bottom hasp elements and the shackle of a lock device installed through the hasp elements. The cover is a unitary rigid box-like device having a contiguous front wall, laterally opposed side walls, a top end wall, an open back side, and an open bottom end defining an interior. Axially aligned apertures through each laterally opposed side wall are sized and shaped to slidably receive the camming handle of the cargo door. A recess in the top end wall is sized and shaped to allow pivotal movement therethrough of the top hasp element into and out of the cover interior. The open bottom end allows the lock device to be manually inserted upwardly therethrough into the interior and manipulated to secure the shackle through aligned apertures in the top and bottom hasp elements. The open bottom also allows the user to easily grip and hold the body of the lock with the fingers of one hand while using a key held in the other hand to lock and unlock the lock device. The open back side and bottom end allow the cargo door camming handle to be raised, lowered, and pivoted while the cover is installed on the handle and the handle is free of the top hasp member.

SUMMARY OF THE INVENTION

It is therefore an object of the present invention to provide a hasp and lock cover for cargo doors of cargo carrying vehicles and shipping containers which will prevent unauthorized access to the door latching and locking elements.

It is another object of this invention to provide a hasp and lock cover for cargo doors which is removably received on the cargo door camming handle and configured to substantially enclose the hasp elements, a portion of the handle locked in the hasp, and the shackle of a lock installed through the hasp elements.

Another object of this invention is to provide a hasp and lock cover for cargo doors which does not require modification of the existing cargo door camming handle nor the existing hasp elements.

Another object of this invention is to provide a hasp and lock cover for cargo doors which is easily and quickly installed on and removed from the cargo door camming handle.

Another object of this invention is to provide a box-like hasp and lock cover for cargo doors which has a recess in its top wall to allow pivoting movement of the top hasp element therethrough to facilitate securing and releasing the cargo door camming handle.

Another object of this invention is to provide a box-like hasp and lock cover having an open bottom end to facilitate installation and removal of the shackle of a lock into and out of aligned apertures in the hasp elements.

Another object of this invention is to provide a box-like hasp and lock cover having an open bottom end to allow the user to easily grip and hold the body of the lock with the fingers of one hand while using a key held in the other hand to lock and unlock the lock device.

Another object of this invention is to provide a box-like hasp and lock cover having an open back side and bottom end to allow the user to raise, lower, and pivot the cargo door camming handle while the cover is installed on the handle and the handle is free of the top hasp member.

A still further object of this invention is to provide:a hasp and lock cover which is simple in construction and inexpensive to manufacture.

Other objects of the invention will become apparent from time to time throughout the specification and claims as hereinafter related.

The above noted objects and other objects of the invention are accomplished by the present hasp and lock cover for installation on a camming handle of a cargo door of cargo carrying vehicles and shipping containers which substantially covers existing top and bottom hasp elements and the shackle of a lock device installed through the hasp elements. The cover is a unitary rigid box-like device having a contiguous front wall, laterally opposed side walls, a top end wall, an open back side, and an open bottom end defining an interior. Axially aligned apertures through each laterally opposed side wall are sized and shaped to slidably receive the camming handle of the cargo door. A recess in the top end wall is sized and shaped to allow pivotal movement therethrough of the top hasp element into and out of the cover interior. The open bottom end allows the lock device to be manually inserted upwardly therethrough into the interior and manipulated to secure the shackle through aligned apertures in the top and bottom hasp elements. The open bottom also allows the user to easily grip and hold the body of the lock with the fingers of one hand while using a key held in the other hand to lock and unlock the lock device. The open back side and bottom end allow the cargo door camming handle to be raised, lowered, and pivoted while the cover is installed on the handle and the handle is free of the top hasp member.

DESCRIPTION OF THE PREFERRED EMBODIMENT

Figure 1:
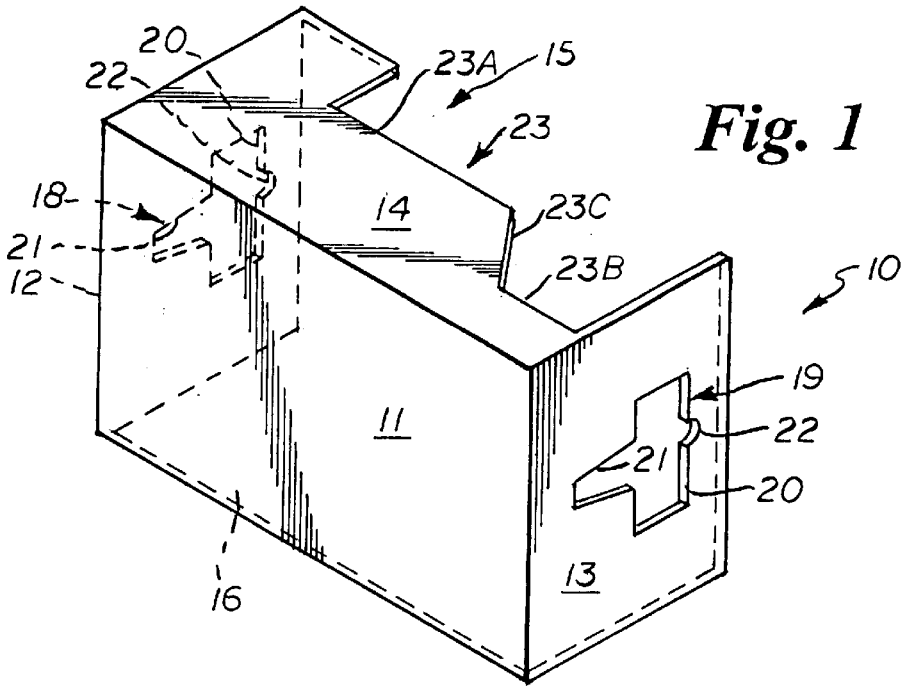
FIG. 1 is a perspective view of the hasp and lock cover for cargo doors in accordance with the present invention, shown from the top and front side.
Figure 2:
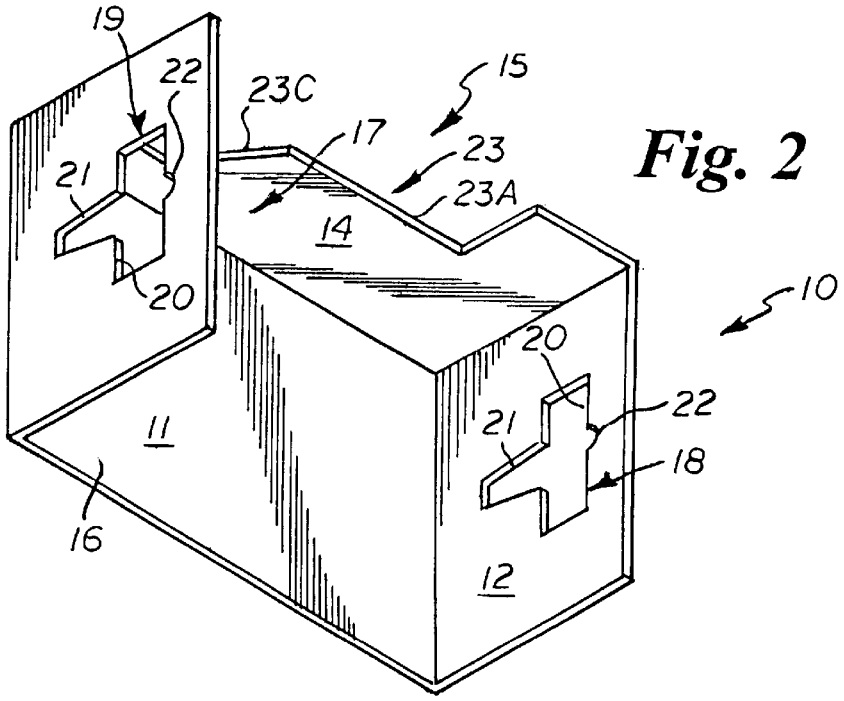
FIG. 2 is a perspective view of the hasp and lock cover shown from the bottom and back side.

Referring to the drawings by numerals of reference, there is shown a hasp and lock cover 10 in accordance with the present invention. The cover 10 is a unitary box-like device having a contiguous front wall 11, laterally opposed side walls 12 and 13, a top end wall 14, an open back side 15, and an open bottom end 16 defining an interior compartment 17. In a preferred embodiment the cover 10 is formed of ⅛" thick steel plate which is bent and welded along the juncture of the top wall 14 with the laterally opposed side walls 12 and 13.

Identical apertures 18 and 19 are formed in the laterally opposed side walls 12 and 13, respectively, which are disposed in laterally spaced alignment. The apertures 18 and 19 are sized and shaped to slidably receive the camming handle H of a cargo door D. There are several types of camming handles which are used on the cargo doors of various cargo carrying vehicles and shipping containers, and each type differs in cross section.

In the preferred embodiment of the cover 10, the single pair of apertures 18 and 19 are configured to accomodate the different cross sections of the several known types of camming handles. In the illustrated example, the apertures 18 and 19 have a larger rectangular opening 20 with an adjoining smaller truncated tapered opening 21 extending a short distance from one side thereof toward the front wall 11 and a concave recess 22 on the opposed side. This configuration will accomodate at least four of the most common camming handle types. The concave recess allows the user to view the interior of the cover 10 from either side when a camming handle is installed through the apertures 18 and 19.

Figure 4:
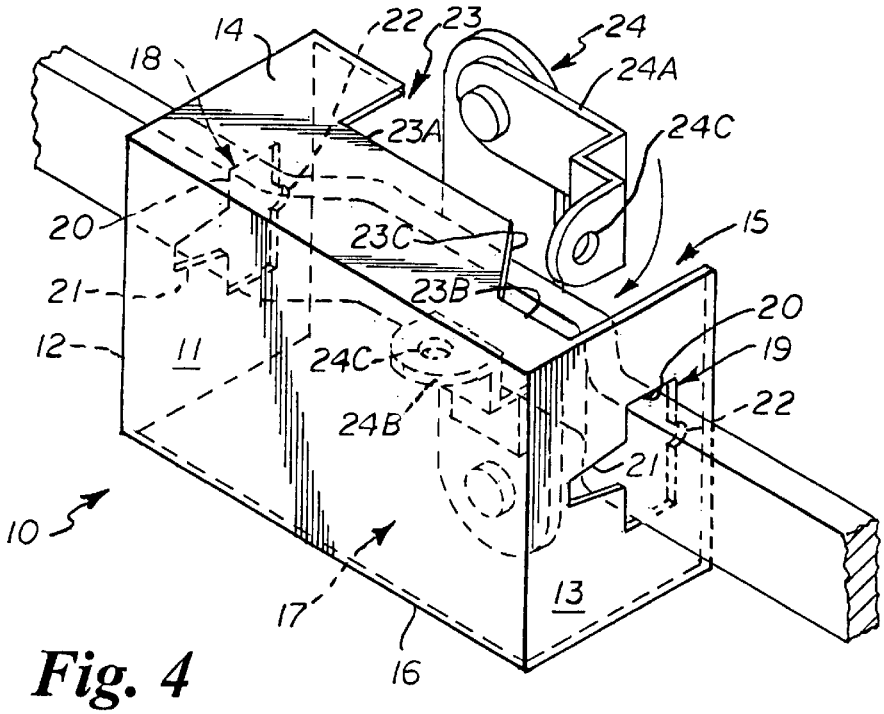
FIG. 4 is a perspective view showing the pivoting top hasp element pivoting downwardly through the recess in the top wall of the hasp and lock cover.

As best seen in FIGS. 1 and 4, the top end wall 14 of the cover 10 is provided with a recess 23 sized and shaped!to allow pivotal movement therethrough of the generally L-shaped top hasp element 24A into and out of the cover interior. There are several types of hasp assemblies which are used on the cargo doors of various cargo carrying vehicles and shipping containers, and the L-shaped pivoting top member of each type differs slightly in shape and size.

The recess 23 in the top end wall 14 has a shape in the general form of the side profile of the top hasp element 24 to allow pivotal movement of the top hasp element therethrough as it is moved into and out of alignment with the stationary lower hasp element 24B of the hasp assembly 24. In the illustrated example, the recess 23 in the top wall 14 has a rectangular shallow recess 23A starting a short distance inwardly from the side wall 12 and extending longitudinally along the rear of the top wall and terminating in a deeper recess 23B at the side wall 13 that extends toward the front wall 11 with a tapered side 23C extending angularly between the shallow recess and the deeper recess. This configuration will accomodate the profiles of the generally L-shaped pivoting top member of at least four of the most common types of hasp assemblies.

The cover 10 is of a size sufficient to allow a user to easily insert the shackle of a conventional padlock into the interior of the cover from the open bottom end 16 in an open condition at one side of the hasp assembly and hook it through the aligned apertures 24C in the hasp members and thereafter secure the end of the shackle S into the lock body L.

The open bottom bottom end 16 of the cover 10 allows the user to easily grip and hold the body of the padlock L with the fingers of one hand while using a key held in the other hand to lock and unlock the padlock.

The open bottom bottom end 16 of the cover 10 also allows the user to raise, lower, and pivot the handle H while the cover is installed on the handle and the handle is free of the top hasp member 24A. In other words, it is not necessary to remove the cover from the handle in order to manipulate the handle and to open or close the cargo doors. In order to manipulate the handle H, it is only necessary to pivot the top hasp member 24A away from the bottom hasp member 24B to free the handle.

Figure 3:
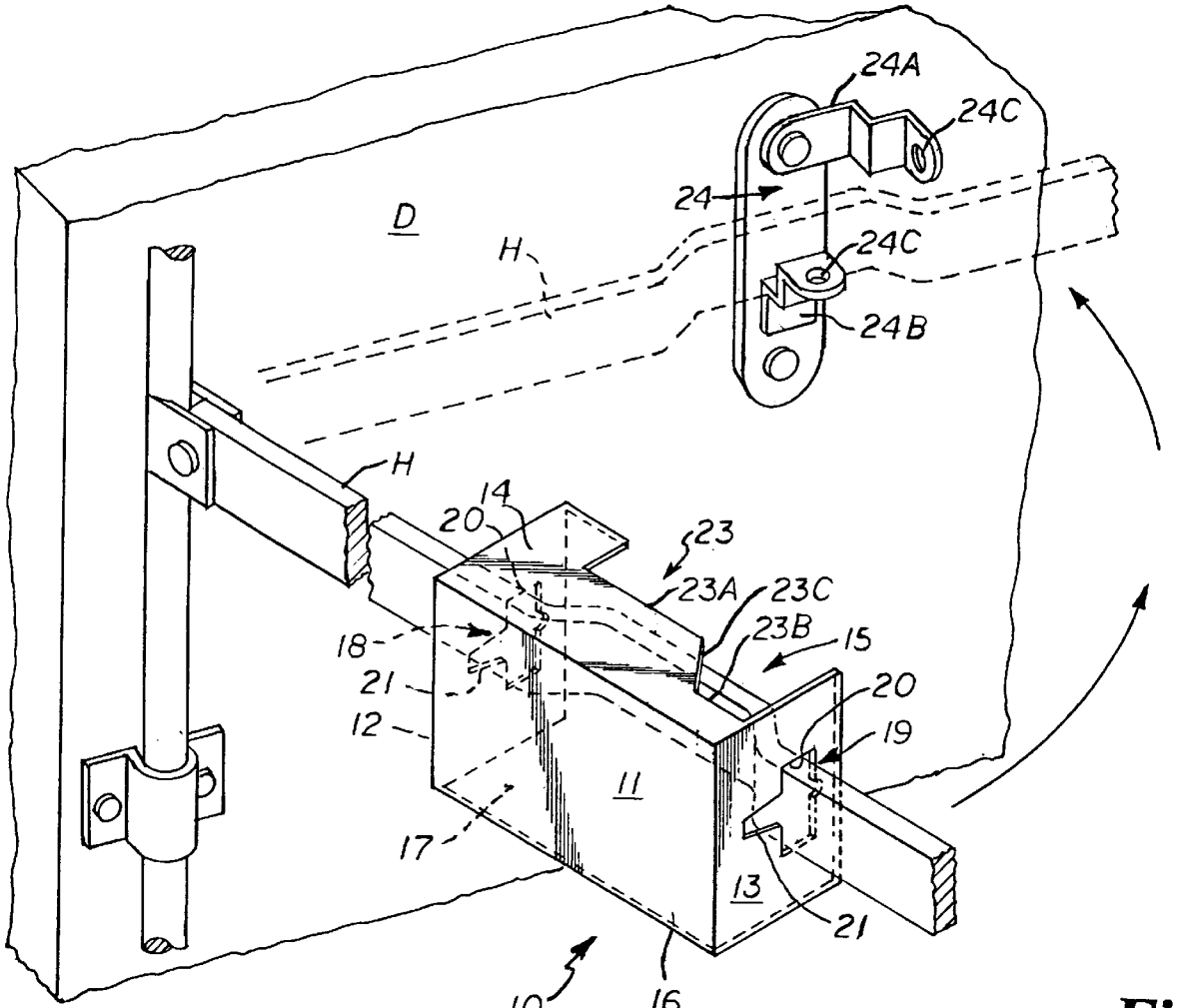
FIG. 3 is a perspective view showing the hasp and lock cover installed on a camming handle of a cargo door prior to placing the handle in the bottom hasp element on the door.
Figure 5:
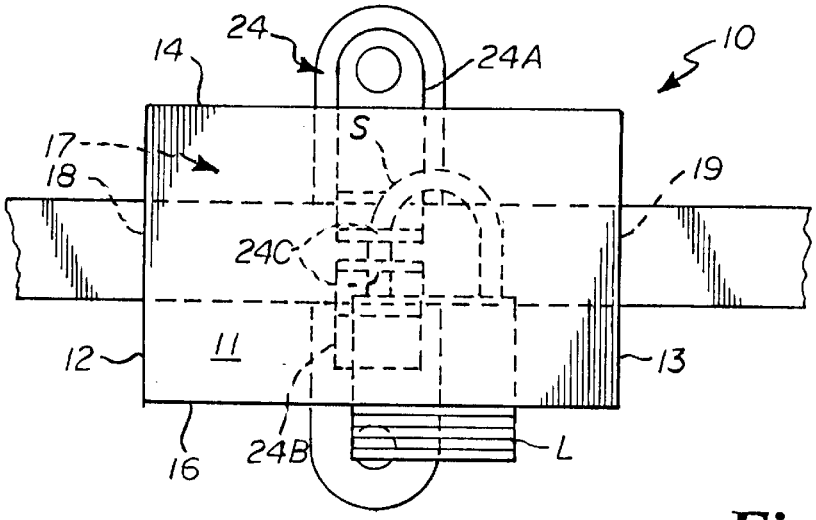
FIG. 5 is a front elevation of the door handle secured in the hasp by a padlock whereby the hasp and shackle of the padlock are substantially covered by the hasp and lock cover.

As best seen in FIGS. 3, 4, and 5, to install the cover 10, the user aligns the aperture 18 or 19 in the side wall 12 or 13 with the free end of the camming handle H and slides the cover onto the handle with the handle passing through the apertures 18 and 19, and the cover is positioned on the handle at location such that it will cover the hasp assembly 24. The top hasp member 24A is pivoted outwardly away from the bottom hasp member 24B, the handle H with the cover 10 thereon is placed onto the bottom hasp member 24B, and the top hasp member 24A is released to pivot downwardly through the recess 23 in the top wall. When the top hasp member 24A swings downward in front of the handle H, the holes 24C in the top and bottom hasp members are aligned and the handle is captured by the hasp assembly 24.

The user inserts the shackle S of a conventional padlock L into the interior of the cover 10 from the open bottom end 16 in an open condition at one side of the hasp assembly 24 and hooks it through the aligned holes 24C in the hasp members and thereafter secures the shackle into the lock body L. The user then grips and holds the body of the padlock with the fingers of one hand while using a key held in the other hand to lock the padlock.

When the camming handle H is secured in the hasp assembly 24 by the padlock, the open back side 15 of the cover 10 is flush against the outer surface of the cargo door and only the bottom portion of the padlock body L is exposed through the open bottom end 16 of the cover. The hasp assembly 24 and the shackle S of the lock L is enclosed within the interior of the cover and inaccessable to a hacksaw, bolt cutters and other devices commonly used to cut or break a lock.

To remove the lock and open the cargo doors, the user grips and holds the body of the padlock L with the fingers of one hand while using a key held in the other hand to unlock the padlock. The lock body is lifted to unhook the shackle S from the holes 24C in the hasp assembly and the padlock is removed through the open bottom end 16 of the cover. The user then pivots the top hasp member 24 A outwardly away from the bottom hasp member 24B, and moves the handle H with the cover 10 thereon away from the bottom hasp member. The camming handle H with the cover 10 installed thereon can then be raised and lowered, and pivoted as necessary to clear the hasp assembly and to open or close the cargo doors.

While this invention has been described fully and completely with special emphasis upon a preferred embodiment, it should be understood that within the scope of the appended claims the invention may be practiced otherwise than as specifically described herein.

What is claimed is:

1. A cover for installation on a camming handle of a cargo door of cargo carrying vehicles and shipping containers to substantially cover existing top and bottom hasp elements and the shackle of a lock device installed through the hasp elements, the cover comprising:

a unitary rigid box-like cover having a contiguous front wall, laterally opposed side walls, a top end wall, an open back side, and an open bottom end defining an interior;

an aperture through each said laterally opposed side walls disposed in axial alignment and sized and shaped to slidably receive the camming handle of a cargo door, said apertures having a larger rectangular opening with an adjoining smaller truncated tapered opening extending a short distance from one side thereof toward said front wall;

a recess in said top end wall sized and shaped to allow pivotal movement therethrough of the top hasp element into and out of said cover interior; and said open bottom end sized to allow the lock device to be manually inserted upwardly therethrough into said interior and manipulated to secure the shackle through aligned apertures in the top and bottom hasp elements.

2. The cover according to claim 1, wherein said recess in said top end wall has a shape in the general form of a side profile of the top hasp element to allow pivotal movement of the top hasp element therethrough.

3. The cover according to claim 1, further comprising:

a concave recess on an opposed side of said larger opening disposed in opposed relation to said tapered opening of sufficient size to allow viewing of said interior from either side when said camming handle is installed through said apertures.

* * * * *